United States Patent [19]

Roy

[11] 4,341,300

[45] Jul. 27, 1982

[54] ARTICLE HOLDER AND METHOD OF MANUFACTURE THEREOF

[75] Inventor: Armand W. Roy, Plainville, Mass.

[73] Assignee: Royal Hinge & Die Co., Inc., Plainville, Mass.

[21] Appl. No.: 109,461

[22] Filed: Dec. 31, 1979

[51] Int. Cl.[3] ..... B65D 5/50

[52] U.S. Cl. ..... 206/45.14; 206/566; 206/523

[58] Field of Search ..... 206/45.14, 45.18, 45.19, 206/566, 523

[56] References Cited

U.S. PATENT DOCUMENTS

| | | | |
|---|---|---|---|
| 692,259 | 2/1902 | Flaskamp | 206/45.14 |
| 712,965 | 11/1902 | Reiner | 206/45.14 |
| 2,575,016 | 11/1951 | Hopp et al. | 206/566 |
| 2,963,149 | 12/1960 | Bergh et al. | 206/566 |

OTHER PUBLICATIONS

1978 Evan's Catalog, p. 146x.

*Primary Examiner*—Joseph Man-Fu Moy
*Attorney, Agent, or Firm*—Salter & Michaelson

[57] ABSTRACT

The article holder of the subject invention includes a base member to which a holder member is secured, the base member having a plurality of slots formed in a wall thereof that receive a plurality of prongs that are formed as an integral part of the holder member. The holder member is formed from a metal blank that is rolled into a tubular configuration and is secured to the base member such that the longitudinal axis thereof is inclined to the vertical. Both the base member and the holder member are covered with a decorative material to provide an ornamental appearance for the article holder in the display of an article thereon. In the fabrication of the holder member, the metal blank is die cut into a specific configuration, and thereafter is covered with the decorative material prior to the rolling thereof to the tubular configuration.

5 Claims, 8 Drawing Figures

ARTICLE HOLDER AND METHOD OF MANUFACTURE THEREOF

BACKGROUND OF THE INVENTION

The present invention relates to an article holder and to a method of manufacture thereof, and primarily is provided for the packaging and display of jewelry articles such as finger rings or the like.

Prior to the instant invention, holders that have been used in the display of finger rings or the like on conventional counter fixtures or in the packaging thereof in ring boxes have normally been made of wood, the wood base and ring mount being individually hand-worked to the finished form. In the assembly of these prior known ring holders, the ring mount which was defined by an especially shaped wood piece that had a tapered configuration was secured to the base by an adhesive or by a fastener or the like. In such prior known constructions, the fabrication of the ring mount was time consuming and therefore uneconomical because of the labor required to separately form the ring mount in its required configuration. Further, the use of special wood materials which necessarily required the special working thereon substantially increased the cost of the prior known article holder.

The present invention is designed to avoid the expensive and time-consuming steps in forming and shaping the wood pieces of the prior known article holders and produces a finished article holder that is fabricated of metal, but that is substantially identical in appearance to the conventional wood article holder.

Applicant is not aware of any prior art that discloses the combination as embodied in the subject invention, and the following U.S. patents represents the best prior art known to applicant that pertain to the subject invention: BOYDEN, No. 542,751; FOLTS, No. 1,586,665; SHIELDS, No. 1,636,251; SUNDEE, No. 1,907,581; ALLEN, No. 2,517,758; HOPP et al., No. 2,575,016; and BERGH et al., No. 2,963,149.

SUMMARY OF THE INVENTION

The article holder embodied in the present invention includes a base member having a top wall in which a plurality of slots are formed in predetermined spaced-apart relation. A holder member is mounted on the base member and receives the article for display thereon, the holder member being formed of a metallic material and having a generally hollow configuration. The hollow holder member is shaped such that the longitudinal axis thereof is inclined with respect to the vertical and has a plurality of spaced-apart prongs that are joined to the lowermost edges thereof, the prongs being receivable in the slots as formed in the top wall of the base member and being bent into engaging relation with the underside of the base member wall to firmly lock the holder member in the base member in an inclined position relative thereto. A decorative covering is applied to the exterior surfaces of the top wall of the base member and to the holder member to provide an ornamental appearance therefor.

In the fabrication of the holder member, a metallic blank is die cut into a flat body having a predetermined configuration and with the prongs formed thereon. Thereafter, the decorative covering is applied to a surface of the body, and the body is then rolled to a tapered tubular configuration, the prongs in the rolled form of the holder member being located at the lower and larger end thereof. After the decorative covering has been applied to the top wall of the base member, the rolled holder member is secured thereto by inserting the prongs through the slots as formed in the base member wall and by bending over the prongs into engagement with the underside of the wall.

Accordingly, it is an object of the present invention to provide an article holder and method of manufacture thereof wherein the article holder is designed to replace the conventional wood-type article holder and includes an inclined holder member that is rolled from blank form to a tubular configuration and is secured to a base member by the insertion of prongs through appropriately formed slots located in the base member.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention:

FIG. 7 is a perspective view of another modification of the invention illustrating the use thereof as a writing instrument holder or the like.

DESCRIPTION OF THE INVENTION

Figure 1:
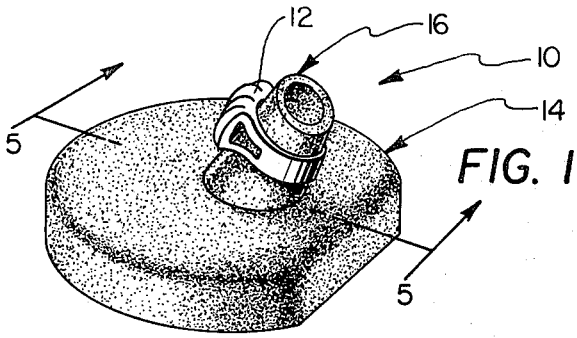
FIG. 1 is a perspective view of one form of the article holder embodied in the present invention, the article holder being illustrated in the fully assembled position thereof.
Figure 4:
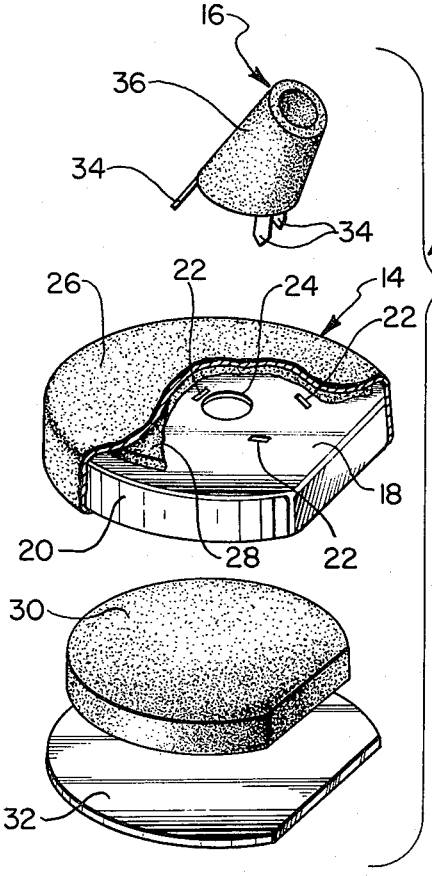
FIG. 4 is an exploded perspective view of the article holder as illustrated in FIG. 1, showing the various components thereof.
Figure 5:
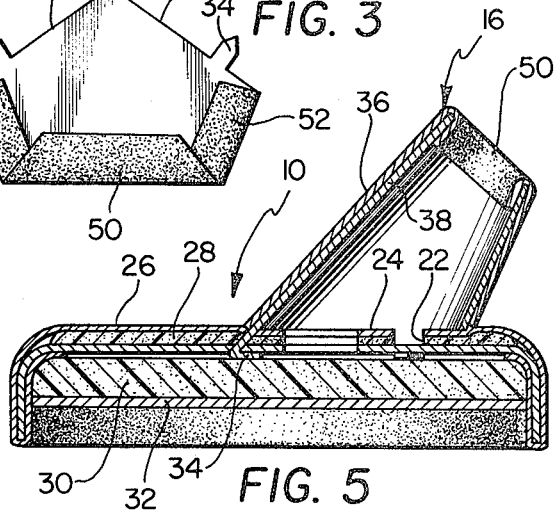
FIG. 5 is a sectional view taken along line 5—5 in FIG. 1.

Referring now to the drawing and particularly to FIGS. 1, 4 and 5, one form of the article holder embodied in the present invention is illustrated and is generally indicated at 10. As shown, the article holder 10 is designed for use in the display of ornamental articles, such as finger rings, one of which is indicated at 12 in FIG. 1. As will be described, the finger ring 12 is mounted on a component of the article holder 10 so as to be visually accessible when the article holder is placed on a counter or in a display case or the like. As will be further described, the article holder 10 embodied herein may be utilized to retain or hold other articles thereon without substantial modification thereof, although the preferred use of the invention as indicated is in the display and packaging of ornamental articles such as finger rings or the like.

As shown more clearly in FIG. 4, the article holder 10 includes a base member generally indicated at 14 and a holder member generally indicated at 16 that is mounted on the base member. The base member 14, as illustrated in FIG. 4, is defined by a top wall 18 to which a downwardly extending, a peripheral wall 20 is integrally joined. The base member as defined by the bottom wall 18 and the peripheral wall 20 is preferably formed of a metal material and in the fabrication thereof is preferably drawn to the configuration as illustrated by any well-known metal drawing technique. Punched out of the wall 18 and located in spaced relation therein are a plurality of slots 22 that are arranged in a predetermined pattern for accommodating prongs as formed on the holder member 16, as will be described hereinafter. Also formed in the wall 18 and located between the slots 22 is an opening 24, the purpose of which will also hereinafter be described.

Prior to the mounting of the holder member 16 on the base member 14, a decorative covering 26 is applied to the base member. As shown in FIGS. 4 and 5, an inner pad 28 preferably of a foam material is located on the top wall 18 in contact with the upper surface thereof and is completely concealed by the decorative covering 26 when the covering is applied to the top wall. As will be described, the foam pad 28 provides a cushion effect for the covering 26 that enables the covering 26 to be slightly depressed when the holder member 16 is fixed to the base member 14. Thus, the foam pad 28 acts to receive the lowermost edges of the holder member 16 in cushioned relation, wherein these edges sink into the covering 26 so that a one-piece effect between the holder member and base member is produced. Further, the resilient foam pad 28 imparts a soft "feel" to the base member 14 when the article holder 10 is handled by the user. Referring again to FIGS. 4 and 5, an under pad 30 and a bottom backing card 32 are shown and are inserted into the underside of the base member 14 to provide a finished construction therefor, the outermost surface of the card 32 also being covered with some form of a decorative material that is similar to the decorative material 26.

Referring to FIGS. 1 and 5, the holder member 16 which is shown mounted in position on the base member 14 is located such that the longitudinal axis thereof is inclined to the vertical. Further, the configuration of the holder member 16 is tapered, the larger end of the tapered holder member being positioned on the top wall 18 of the base member 14. As illustrated, the holder member 16 is tubular in construction, and is also formed with a plurality of prongs 34 thereon that extend below the lowermost edges thereof. The prongs 34 are spaced apart in predetermined relation so as to be accommodated in the slots 22 as formed in the top wall 18 of the base member 14; and as shown in FIG. 4, the slots 22 are oriented so as to receive the prongs 34 in such a manner as to locate the holder member 16 in an appropriate position on the base member 14, wherein the holder member is inclined toward the rear end of the base member. In this position the inclination of the holder member 16 as mounted on the base member 14 enables the ring 12 as mounted thereon to be easily visible when the article holder 10 is placed in a display case or the like.

As will be described hereinafter, the holder member 16 is formed of a flat metal material in blank form, and is rolled to the configuration as illustrated in FIGS. 1 and 4, following the die cutting thereof to the required shape. Prior to the mounting of the rolled holder member 16 on the base member 14, a decorative cover 36 is applied to the body thereof as die cut, the cover 36 being in the form of a velvet-like material, and being coordinated with the covering 26 as located on the base member 14 to provide an ornamental appearance for the assembled holder member.

Figure 2:
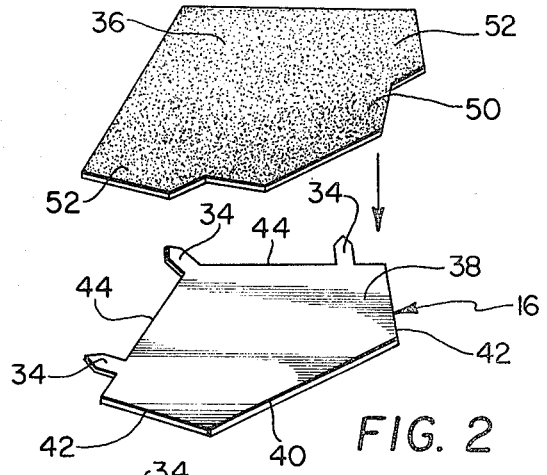
FIG. 2 is an exploded perspective view of a metal blank body and a covering therefor, wherein the blank body is shown after the die cutting thereof and just prior to the application of the covering thereto.
Figure 3:
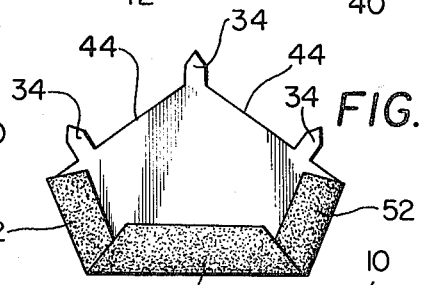
FIG. 3 is a top plan view of the rear side of the metal blank body after the decorative covering has been applied thereto.

One of the unique features embodied in the subject invention is the method of manufacture of the holder member and the base member which includes the manner in which the holder member is assembled on the base member. Referring now to FIGS. 2 and 3, the holder member 16 is illustrated after it has been die cut from a blank and prior to the rolling thereof. In this connection, the holder member 16 comprises a blank body 38 that is pentagonal in configuration and is defined by an outer edge 40, side edges 42 that are equal in dimension, and inner edges 44 that are also equal in dimension. As indicated, the blank body 38 is die cut in the shape as illustrated in FIG. 2, and as formed, includes a pair of the prongs 34 that are formed on the edges 44 and another prong 34 that is located at the junction of the edges 44. Prior to rolling the blank body 38 to the tubular configuration as illustrated in FIG. 4, the body 38 which is formed of a relatively flexible metallic material receives the ornamental covering 36 thereon. As shown in FIG. 2, the covering 36 is also die cut in a specific configuration to enable it to be precisely placed over the blank body 38. For this purpose, the covering 36 is formed with an end flap 50 and side flaps 52. An adhesive is applied to the underside of the covering 36 and the covering is then applied to the facing surface of the blank body 38 of the holder member 16, the flaps 50 and 52 being folded over the corresponding edges 40 and 42, respectively, in the manner as illustrated in FIG. 3. Alternatively, the covering 36 is applied to the blank body 38 by heat sealing. With the decorative covering 36 adhered to the blank body 38 of the holder member 16, the blank body is then rolled to the tubular configuration as illustrated in FIG. 4, wherein the edges 42 are moved into abutting relation and extend the length of the tubular holder member along a side thereof. In the rolled or tubular configuration, the prongs 34 are located at the lowermost edge of the holder member 16 and are positioned for insertion through the slots 22 of the top wall 18 of the base member 14.

In the rolling of the blank body 38, the edge 40 defines the uppermost end of the holder member 16, the pentagonal configuration of the blank body 38 further providing for the tapered configuration of the holder member 16 in its finished rolled form. As also illustrated, the longitudinal axis of the holder member 16 is inclined to the vertical so that when the holder member 16 is secured in place to the top wall 18 of the base member 14, the inclination of the holder member provides for proper display of a finger ring thereon.

As previously described, prior to the attachment of the holder member 16 to the base member 14, the covering 26 has been applied to the base member 14 with a foam pad 28 thereunder. As more clearly shown in FIG. 5, the covering 26 extends over the top wall 18 and around the peripheral side wall 20 to the inside thereof for attachment to the inside of the side wall 20 and the underside of the top wall 18. After securement of the holder member 16 to the base member 14, the pad 30 and backing card 32 are inserted in the underside of the base member 14 to complete the assembly of the article holder. As described above, in addition to the pad 28 providing a cushioned surface for the base member 14, it also serves to conceal any external or exposed edges of the metal portion of the holder member 16 when it is secured to the base member. Thus, the lowermost edges of the holder member 16 as mounted on the base member 14 are buried in the cushioned cover 26 so as to not only conceal any exposed metal edges of the holder member 16, but also to produce a one-piece unitary effect between the holder member 16 and base member 14.

Figure 6:
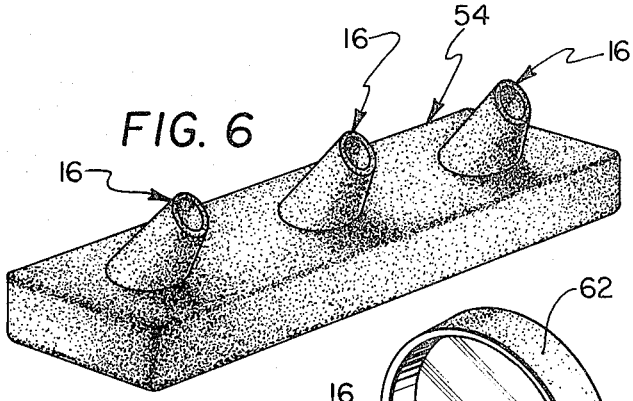
FIG. 6 is a perspective view of a modified form of the invention illustrating a plurality of the holder members as mounted on an elongated base member.

Referring now to FIG. 6, a modified form of the invention is illustrated, wherein an elongated rectangularly-shaped base member generally indicated at 54 is illustrated. The base member 54 is also formed of a metal material, and in the fabrication thereof, is drawn to the configuration as illustrated and includes an upper wall and a downwardly extending peripheral side wall integrally joined thereto. Although not shown, a plurality of sets of slots are formed in the upper wall of the base member 54 for receiving the prongs 34 of each of the holder members 16 that are mounted in place on the base member 54 in the manner as described above. Thus, a plurality of articles such as finger rings may be located for display in side-by-side relation on the spaced-apart holder members 16 in the form of the invention as shown in FIG. 6.

Figure 7:
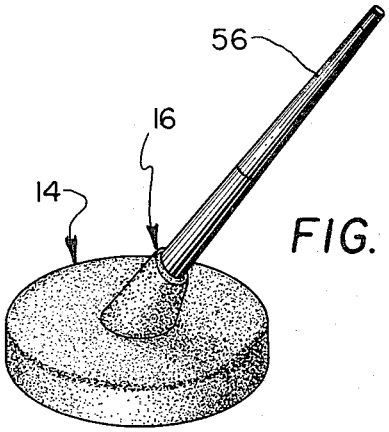

In the form of the invention illustrated in FIG. 7, the article holder 10 is constructed in substantially the identical manner as illustrated in FIGS. 1–5. However, the article holder 10 is intended for the support or display of an elongated article such as a writing instrument indicated at 56 in FIG. 7. Since the lowermost end of the writing instrument 56, which may be in the form of a pen, extends beyond the lowermost end of the holder member 16, the opening 24, as previously described, is formed in the top wall 18 of the base member 14 and receives the point end of the pen 56 therein. The article holder 10 with the pen 56 received in the holder member 16 thereof is thus employed as a desk pen set. In this connection, it is understood that any suitable decorative covering may be applied to the base member 14 and the holder member 16, depending upon the type of writing instrument 56 to be employed therewith.

Figure 8:
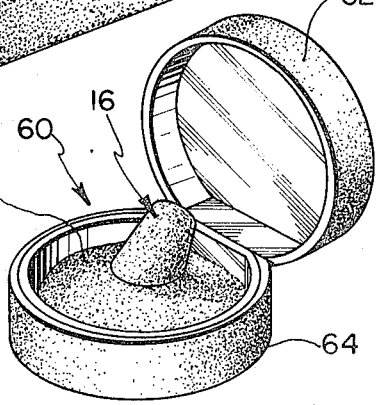
FIG. 8 is a perspective view showing a still further modified form of the invention, wherein a modified holder member is mounted in a display box.

Referring now to FIG. 8, a further modified form of the invention is illustrated; and as shown the article holder 16, which is constructed in the manner as described hereinabove, and which is provided with a decorative covering thereon, is attached to a flat base member indicated at 58. The base member 58 as illustrated is constructed in the form of a flat cardboard card, and includes a pad that is located thereon and that is disposed beneath a decorative covering, such as a velvet material that was also described as being utilized in connection with the forms of the invention described hereinabove. The purpose of the article holder as illustrated in FIG. 8 is to package an article such as a finger ring in a display box for display or shipping, and in this connection the display box which is generally indicated at 60 includes a top section 62 and a bottom section 64 that are hingedly connected together in any convenient manner. The top and bottom box sections 62 and 64 are formed in the usual manner so as to define cavities therein, and the base member 58 to which the holder member 16 is applied has a configuration that corresponds to the cavity as formed in the bottom section 64 and is received therein in friction relation so as to be positively held in place. The article holder 16 extends above the side walls of the bottom section 64 and is received in the cavity of the top section 62 when the top section 62 is located in a closed position over the bottom section. It is also understood that the walls of the top and bottom sections may be decoratively covered in any suitable manner, as is conventionally known in display boxes of this kind.

It is seen that the invention as described herein provides for the convenient display and/or packaging of an article holder, such as a finger ring, and enables the article holder to be conveniently and easily constructed without the requirement for fabrication of expensive wooden parts. Further, the article holder is durable because it is constructed of metal materials; and by utilizing the unique method of manufacture described herein, the article holder is not only economical to make but is ornamental as well.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An article holder comprising:

a. a base member having a generally horizontal top wall with a plurality of slots formed therein in predetermined spaced apart relation;

b. at least one holder member mounted on said base member for receiving an article for display thereon, said holder member being formed of a metallic sheet material in generally upwardly tapered hollow tubular configuration with the lowermost edges thereof in substantially coplanar relation, said holder member being disposed with said lowermost edges in communication with said top wall and being shaped such that the longitudinal axis thereof is inclined with respect to the vertical;

c. a plurality of spaced apart prongs joined to said lowermost edges and received in said slots in said top wall and bent into engaging relation with the underside of said top wall to firmly lock said holder member on said top wall in an inclined position relative thereto;

d. a decorative covering secured to the exterior surfaces of said holder member;

e. a foam-like pad overlaid on the upper surface of said top wall; and f. a decorative covering overlaid on said pad and secured to said base member, said decorative coverings providing an ornamental appearance for said holder member, said base member covering capturing said pad on said base member to provide a resilient top surface for said top wall, whereby said lowermost holder member edges are received on said covering on said top wall in cushioned relation and buried therein to produce a one-piece effect between said holder member and said base member.

2. An article holder as claimed in claim 1, said base member being formed of a metallic material and being drawn to form a downwardly extending peripheral edge that is integrally joined to said top wall, said top wall and peripheral edge defining a recess, and a backing member being received on the underside of said base member in said recess for concealing the bent-over prongs that are secured to said base member.

3. An article holder as claimed in claim 1, the top of said holder member being open for receiving an end of an elongated article such as a writing instrument therein, wherein the remaining portion of said writing instrument extends outwardly of said holder member for convenient access thereto.

4. An article holder as claimed in claim 1, the top wall of said base member having a plurality of sets of slots formed therein, said sets of slots being located in said wall in spaced-apart relation and a plurality of holder members having sets of prongs joined to the lowermost edges, said prongs of each holder member being received in a set of slots, wherein said holder members are secured to said base member in side-by-side spaced relation.

5. An article holder as claimed in claim 1, a box having a bottom section formed with a bottom wall and side walls to define a cavity therebetween, and a top section hingedly joined to said bottom section for covering said bottom section cavity in the closed position of said box, said base member and said article holder secured thereto being located in the cavity as formed in said bottom section for retaining an article in a display position therein.

* * * * *